US006330723B1

(12) United States Patent
Orgias

(10) Patent No.: US 6,330,723 B1
(45) Date of Patent: Dec. 18, 2001

(54) AIR FRESHENING TOILET SEAT

(76) Inventor: Peter D. Orgias, 22 E. 58 St., Brooklyn, NY (US) 11203

( * ) Notice: Subject to any disclaimer, the term of this patent is extended or adjusted under 35 U.S.C. 154(b) by 0 days.

(21) Appl. No.: 09/413,346

(22) Filed: Oct. 6, 1999

(51) Int. Cl.[7] ..... A47K 13/24
(52) U.S. Cl. ..... 4/237; 4/228.1; 4/229
(58) Field of Search ..... 4/228.1, 229, 237, 4/234, 242.1, 222

(56) References Cited

U.S. PATENT DOCUMENTS

| | | | | |
|---|---|---|---|---|
| 866,400 | * | 9/1907 | Stevens | 4/229 |
| 1,492,825 | | 5/1924 | Abbott . | |
| 1,576,262 | | 3/1926 | Bank . | |
| 1,703,066 | * | 2/1929 | Horn . | |
| 1,760,598 | | 5/1930 | Horn . | |
| 1,771,960 | * | 7/1930 | Horn . | |
| 2,033,663 | | 3/1936 | Witte . | |
| 2,155,286 | | 4/1939 | Winding . | |
| 2,961,664 | | 11/1960 | Davidson . | |
| 3,249,951 | * | 5/1966 | Thompson | 4/229 |
| 3,333,285 | | 8/1967 | Null . | |
| 3,659,296 | | 5/1972 | Stamper . | |
| 3,949,432 | * | 4/1976 | Ginsburg | 4/237 |
| 4,301,555 | | 11/1981 | Poister . | |
| 4,525,880 | * | 7/1985 | Bass | 4/229 |
| 5,383,237 | * | 1/1995 | Baker | 4/228.1 |
| 5,426,793 | * | 6/1995 | Mac | 4/237 |

* cited by examiner

*Primary Examiner*—Charles R. Eloshway
(74) *Attorney, Agent, or Firm*—Jordan and Hamburg LLP

(57) ABSTRACT

A compressible, air freshening toilet seat adapted for being secured to a toilet bowl includes a cushioning top layer, a rigid bottom layer, an inner periphery, an outer periphery, a compressible chamber, and a plurality of receptacle structures. The top layer is formed of a resilient, cushioning material. The bottom layer has sufficient rigidity for supporting a body weight of a user, and is fixedly attached to the top layer about the peripheries. The chamber is enclosed and defined by the top layer, the bottom layer, and the peripheries. Each of the receptacle structures has an open first end with a retaining lip, and is defined at a predetermined location within the top layer or the bottom layer. Each of the receptacle structures is dimensioned and configured for receiving and removably containing an air freshening element and for permitting a sufficient amount of air freshening agent from the air freshening element to be directed into the atmosphere. Each of the receptacle structures is adapted for permitting ready access to the air freshening element, and is in communication with the chamber, with the air freshening element, and with the atmosphere. Each of the receptacle structures is adapted for restricting movement of the air freshening element within that respective receptacle, and has at least one opening. The receptacle structure may also have a plurality of slots at a side for the freshening agent to be dispensed into the atmosphere. The seat may further include a removable cartridge adapted for receiving an air freshening element and/or an air freshening agent.

13 Claims, 5 Drawing Sheets

AIR FRESHENING TOILET SEAT

BACKGROUND OF THE INVENTION

The present invention relates generally to a toilet seat which acts upon odors in the atmosphere. More specifically, a compressible, air freshening toilet seat is adapted for being secured to a toilet bowl.

Many people would like to own a toilet seat that freshens the atmosphere about the user and that provides cushioning support for the user. An air freshening toilet seat which effectively freshens the atmosphere about the user would therefore be desirable. An air freshening toilet seat which effectively provides cushioning support for the user would also be desirable. An air freshening toilet seat which has at least one accessible receptacle structure for removably containing an air freshening element would further be desirable. The present invention achieves these goals through a cushioning top layer, a rigid bottom layer, an inner periphery, an outer periphery, a compressible chamber, and a plurality of receptacle structures.

Various forms of deodorizing and/or disinfecting toilets, toilet seats, and furniture are known. U.S. Pat. No. 1,492,825, issued on May 6, 1924 to Abbott, discloses a toilet seat which releases a disinfectant. U.S. Pat. No. 1,576,262, issued on Mar. 9, 1926 to Bank and U.S. Pat. Nos. 1,703,066, 1,760,598, and 1,771,960, issued in 1929 and 1930 to Horn, disclose insecticide containers for upholstered furniture. U.S. Pat. No. 2,033,663, issued on Mar, 10, 1936 to Witte, discloses a toilet seat having a reservoir opening to a vaporizing chamber whereby disinfectant or deodorant may be contained in the reservoir. U.S. Pat. No. 2,155,286, issued on Apr. 18, 1939 to Winding, discloses a toilet seat and cover which trap odors and the noise of flushing.

U.S. Pat. No. 2,961,664, issued on Nov. 29, 1960 to Davidson and U.S. Pat. No. 3,249,951, issued on May 10, 1966 to Thompson, disclose toilet seats which release disinfectant or deodorizing fluid to the toilet bowl when sat upon. U.S. Pat. No. 3,333,285, issued on Aug. 1, 1967 to Null, discloses a toilet seat having a filter for absorbing odors and an exhaust fan. U.S. Pat. No. 3,659,296, issued on May 2, 1972 to Stamper, discloses a toilet seat having a cavity to accommodate a deodorizing element and a fan. U.S. Pat. No. 4,301,555, issued on Nov. 24, 1981 to Poister, discloses a toilet seat having a filter for absorbing odors and an optional vacuum pump. U.S. Pat. No. 5,383,237, issued on Jan. 24, 1995 to Baker, discloses a toilet seat which releases a deodorant and/or a disinfectant. U.S. Pat. No. 5,426,793 issued on Jun. 27, 1995 to Mac, discloses a cushioned toilet seat which releases air freshener concealed in its interior cushioning.

None of the above inventions and patents, taken either singly or in combination, is seen to describe the instant invention as claimed.

SUMMARY OF THE INVENTION

The present invention is directed to a compressible, air freshening toilet seat adapted for being secured to a toilet bowl. The seat comprises a cushioning top layer, a rigid bottom layer, an inner periphery, an outer periphery, a compressible chamber, and a plurality of hollow receptacle structures.

The top layer has a top surface, a bottom surface, a plurality of receptacle structures defined therein, and sufficient flexibility, resiliency, and compressibility for providing cushioning support to the user.

Each of the receptacle structures of the top layer has an open first end with a retaining lip, a substantially closed second end, a closed upper side, a closed lower side, and a pair of closed sides, and are optionally generally of rectangular or square shape. Each of the receptacle structures of the top layer is in communication with the chamber, with the atmosphere about the user, and with an air freshening element. Each of the receptacle structures of the top layer is dimensioned and configured for receiving and removably containing a corresponding air freshening element, and for permitting a sufficient amount of an air freshening agent from the corresponding air freshening element to be directed into the atmosphere about the user. Each of the receptacle structures of the top layer is adapted for permitting ready access to the corresponding air freshening element so that the corresponding air freshening element can be replaced or replenished for additional usage.

The receptacle structures of the top layer are preferably defined at predetermined locations within the top layer about the outer periphery. The retaining lip and the second end of each of the receptacle structures of the top layer help to restrict movement of the air freshening element within that respective receptacle yet permitting the air freshening element to be readily accessible. A plurality of slots are provided at the second end for permitting air current generated by compressing the top layer by the user to be directed from the chamber into the atmosphere about the user via the receptacle structure.

The bottom layer has a top surface, a bottom surface, a plurality of hollow receptacle structures defined therein, and sufficient rigidity to support a body weight of the user when the user is positioned upon the seat The bottom layer is shaped generally similar to the top layer, and is fixedly attached to the top layer at or about the peripheries of the seat.

Each of the receptacle structures of the bottom layer has an open first end with a retaining lip, a substantially closed second end, a closed upper side, a substantially closed lower side, and a pair of closed sides. In the embodiment shown, the receptacle structures have a generally rectangular or square shape. Each of the receptacle structures of the bottom layer is in communication with the chamber, with the atmosphere about the user, and with the air freshening means, and is dimensioned and configured for receiving and removably containing a corresponding air freshening element and for permitting a sufficient amount of air freshening agent from the corresponding air freshening element to be directed into the atmosphere about the user via the first end. Each of the receptacle structures of the bottom layer is adapted for permitting ready access to the corresponding air freshening element The receptacle structures of the bottom layer are preferably defined at predetermined locations within the bottom layer about the outer periphery. The retaining lip and each of the second end and of the lower side of each of the receptacle structures of the bottom layer help to restrict movement of the corresponding air freshening element within that respective receptacle structure yet permitting the air freshening element to be readily accessible. A plurality of slots are provided at the upper side and at the lower side for permitting the air current to be directed from the chamber into the atmosphere about the user via the first end and the slots.

The compressible chamber is enclosed and defined by the top layer, the bottom layer, the inner periphery, and the outer periphery. The chamber is in communication with the receptacle structures, the air freshening element, and the slots.

The seat may further comprise at least one removable cartridge that is adapted for being inserted into and removably contained within a corresponding receptacle structure and for receiving the air freshening element and/or the air freshening agent. The removable cartridge corresponding to the receptacle structure preferably has similar features to those of the receptacle structure.

Accordingly, it is a principal object of the invention to provide an air freshening toilet seat which effectively freshens the atmosphere about the user.

It is another object of the invention to provide an air freshening toilet seat which effectively provides cushioning support for the user.

It is a further object of the invention to provide an air freshening toilet seat which has at least one accessible receptacle structure for removably containing an air freshening element.

It is an additional object of the invention to provide an air freshening toilet seat with at least one removable cartridge for containing an air freshening element and/or an air freshening agent.

The above, and other objects, features and advantages of the present invention will become apparent from the following description read in conjunction with the accompanying drawings, in which like reference numerals designate the same elements. It is understood that the drawings are exemplary and not limiting.

BRIEF DESCRIPTION OF THE DRAWINGS

Similar reference characters denote corresponding features consistently throughout the attached drawings.

DETAILED DESCRIPTION

Figure 1:
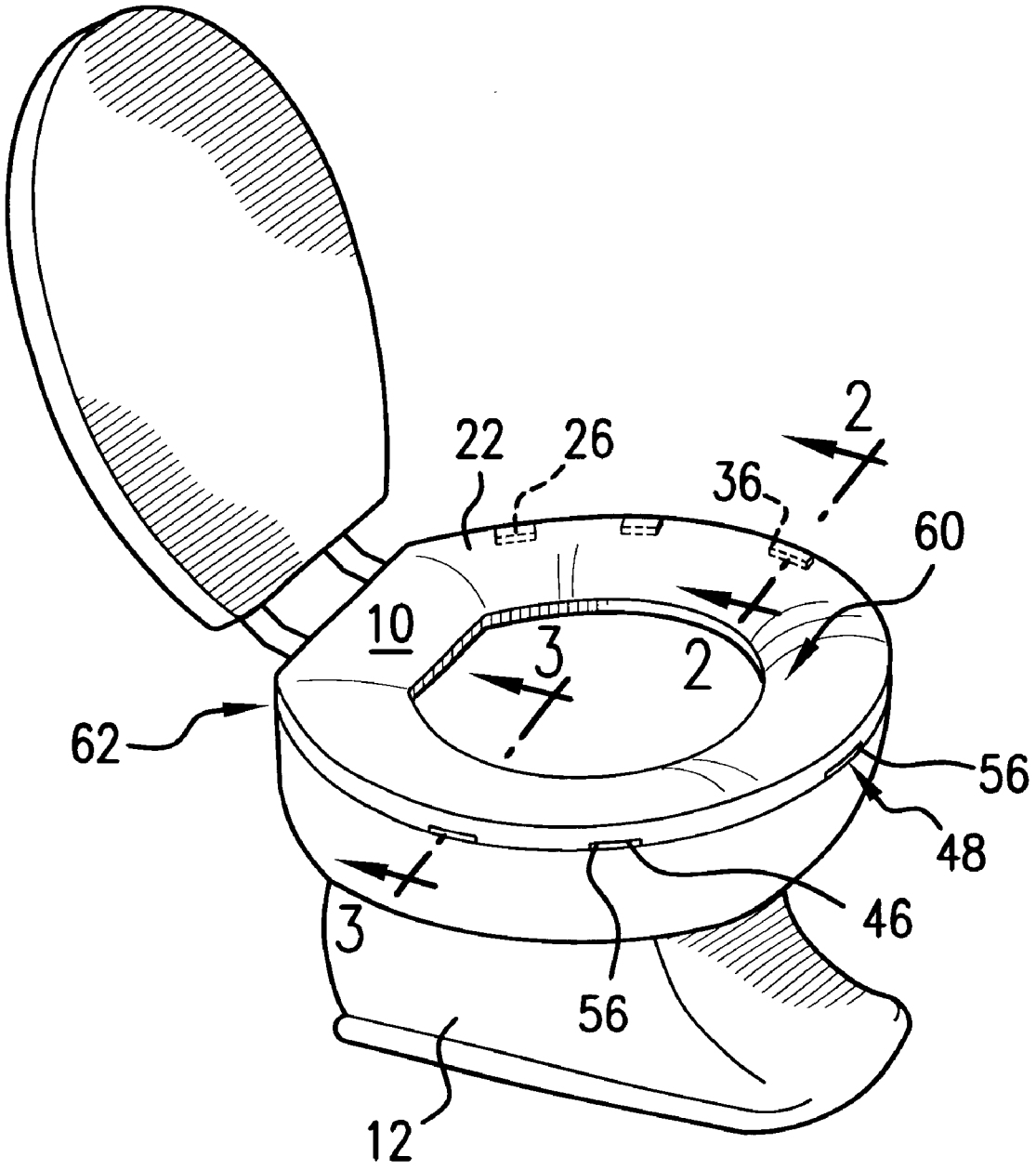
FIG. 1 is an environmental, front and side perspective view of an embodiment of a toilet seat according to the present invention.

Referring to FIGS. 1–9, an embodiment of the present invention is a compressible, air freshening toilet seat 10 adapted for being secured to a toilet bowl 12 and dimensioned and configured for being sat upon by a user is shown. The seat 10 comprises a cushioning top layer 20, a rigid bottom layer 40, an inner periphery 60, an outer periphery 62, a compressible chamber 64, and a plurality of hollow receptacle structures 26, 46.

Figure 2:
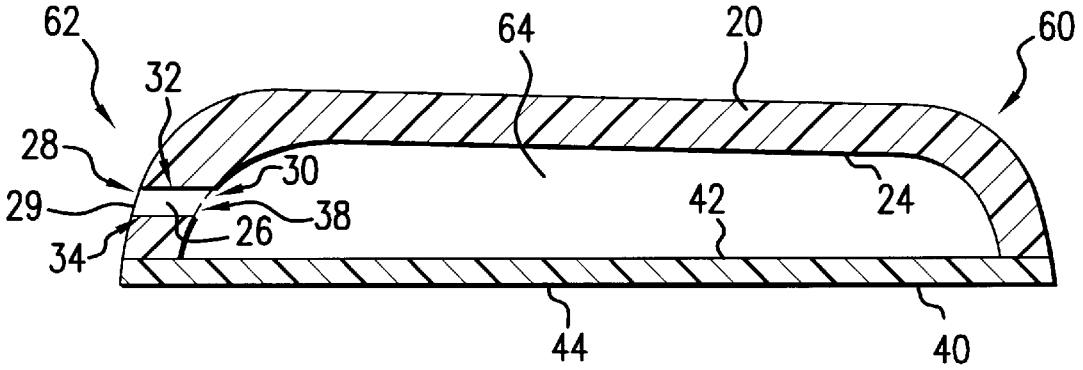
FIG. 2 is a cross-sectional view of the toilet seat of FIG. 1, taken along line 2—2.
Figure 3:
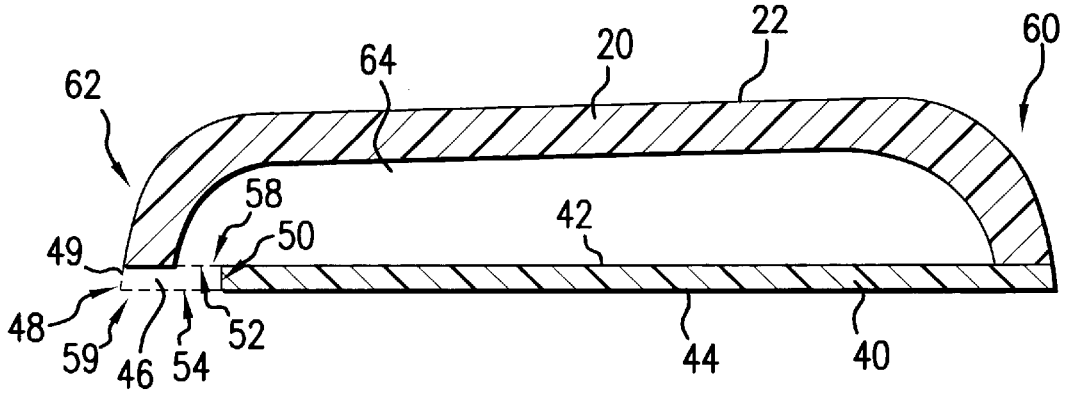
FIG. 3 is a cross-sectional view of the toilet seat of FIG. 1, taken along line 3—3.

As shown in FIGS. 1–3, the top layer 20 has a top surface 22, a bottom surface 24, a plurality of receptacle structures 26 defined therein, and sufficient flexibility, resiliency, and compressibility for providing cushioning support to the user. When the user is positioned upon the seat 10 and makes contact with the top surface 22 of the top layer 20, the top layer 20 is directed downward towards the bottom layer 40 such that the bottom surface 24 of the top layer 20 makes contact with, or comes proximate to, the bottom layer 40. Alternatively, the top layer 20 may be formed of sections of which only some are compressible.

Figure 4:
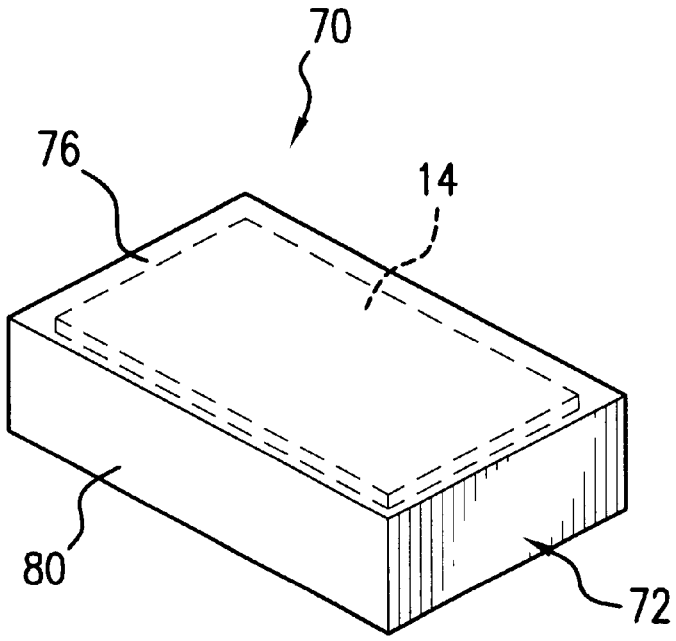
FIG. 4 is a front and side perspective view of a cartridge corresponding to a receptacle structure of a top layer of the toilet seat according to the present invention.
Figure 5:
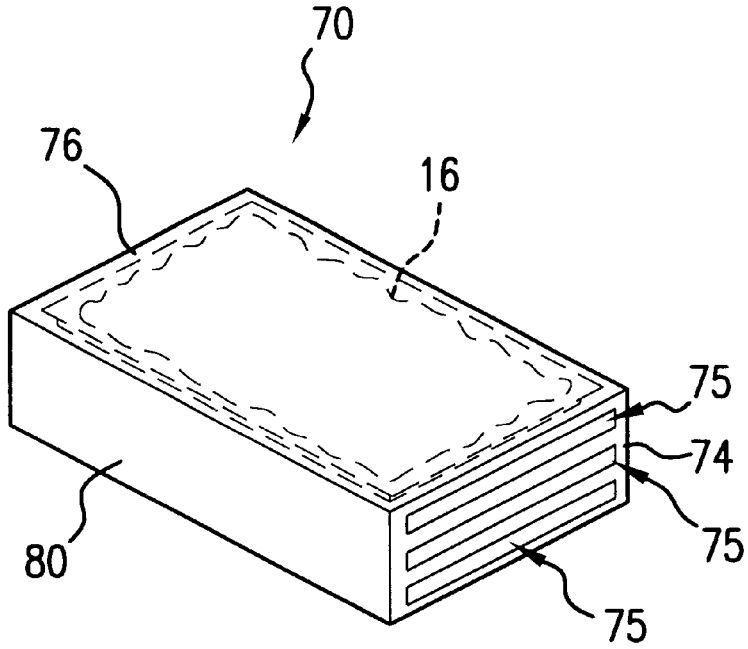
FIG. 5 is a rear and side perspective view of the cartridge corresponding to the receptacle structure of the top layer of FIG. 4.

As shown in FIGS. 1 and 2, each of the receptacle structures 26 of the top layer 20 has an open first end 28 with a flexible retaining lip 29, a substantially closed second end 30, a closed upper side 32, a closed lower side 34, and a pair of closed sides 36. In the embodiment, the receptacle structures 26 are generally of rectangular or square shape, but it is realized that other configurations may be used and such are considered to be within the scope and spirit of the present invention. Each of the receptacle structures 26 of the top layer 20 is in communication with the chamber 64, with the atmosphere about the user, and with air freshening means, such as an air freshening strip 14 (as shown in FIG. 4), a commercial, replaceable air freshening cartridge 16 (as shown in FIG. 5), and any other well known air freshening elements in the art, including scent and odor absorbent releasing variants. Each of the receptacle structures 26 of the top layer 20 is dimensioned and configured for receiving and removably containing a corresponding air freshening means, and for permitting a sufficient amount of air freshening agent (in solid, gel, liquid-soaked wick, liquid-soaked cotton, liquid-soaked cloth, or any other well known form in the art), such as air freshening scent, odor absorbent, and any other well known agents, from the corresponding air freshening means to be directed into the atmosphere about the user. Each of the receptacle structures 26 of the top layer 20 is optionally adapted for permitting ready access, without the use of an additional tool or instrument, to the corresponding air freshening means so that the corresponding air freshening means can be replaced or replenished for additional usage. It is realized that more secure receptacle structures may be provided in embodiments adapted to prevent access by children.

The receptacle structures 26 of the top layer 20 are preferably defined at predetermined locations within the top layer 20 about the outer periphery 62 (as shown in FIGS. 1 and 2) so that the air freshening means is sufficiently effective in freshening the atmosphere about the user and is readily accessible while minimizing the possibility that the air freshening means will make contact with the user. The retaining lip 29 and the second end 30 of each of the receptacle structures 26 of the top layer 20 help to restrict movement of the air freshening means within that respective receptacle structure 26 yet permitting the air freshening means to be readily accessible. As shown in FIG. 2, a plurality of slots 38 are provided at the second end 30 for permitting air current generated by compression of the top layer 20 by the user to be directed from the chamber 64 into the atmosphere about the user via the receptacle structure 26. Alternatively, instead of the slots 38, the second end 30 may be provided with a plurality of holes, a mesh screen, or any other well known means in the art. Furthermore, the open first end 28 may be provided with a movement restricting device in the form of a perforated barrier or mesh.

As shown in FIGS. 1–3, the bottom layer 40 has a top surface 42, a bottom surface 44, a plurality of hollow receptacle structures 46 defined therein, and sufficient rigidity to support a body weight of the user when the user is positioned upon the seat 10. The bottom layer 40 is shaped generally similar to the top layer 20, and is fixedly attached to the top layer 20 at or about the peripheries 60, 62 of the seat 10. The attachment of the top layer 20 to the bottom layer 40 may be accomplished by gluing, stapling, or any other well known method in the art.

As shown in FIGS. 1 and 3, each of the receptacle structures 46 of the bottom layer 40 has an open first end 48 with a flexible retaining lip 49, a closed second end 50, a substantially closed upper side 52, a substantially closed lower side 54, and a pair of closed sides 56. The receptacle structures 46 of the embodiment shown are generally of rectangular or square shape. Each of the receptacle structures 46 of the bottom layer 40 is in communication with the chamber 64, with the atmosphere about the user, with the air freshening means, and is dimensioned and configured for receiving and removably containing a corresponding air freshening means and for permitting a sufficient amount of air freshening agent from the corresponding air freshening means to be directed into the atmosphere about the user via the first end 48. Each of the receptacle structures 46 of the bottom layer 40 is adapted for permitting ready access, without the use of an additional tool or instrument, to the corresponding air freshening means so that the corresponding air freshening means can be replaced or replenished for additional usage. Similar to the receptacle structures 26, more secure receptacle structures 46 may be optionally provided.

The receptacle structures 46 of the bottom layer 40 are preferably defined at predetermined locations within the bottom layer 40 about the outer periphery 62 (as shown in FIGS. 1 and 3) so that the air freshening means is sufficiently effective in freshening the atmosphere about the user and is readily accessible while minimizing the possibility that the air freshening means will make contact with the user. The retaining lip 49 and each of the upper side 52 and of the lower side 54 of each of the receptacle structures 46 of the bottom layer help to restrict movement of the corresponding air freshening means within that respective receptacle structure 46 yet permitting the air freshening means to be readily accessible. As shown in FIG. 3, a plurality of slots 58, 59 are provided at the upper side 52 and at the lower side 54, respectively, for permitting the air current to be directed from the chamber 64 into the atmosphere about the user via the first end 48 and the slots 59. Alternatively, instead of the slots 58, 59, the upper side 52 and the lower side 54 may be provided with a plurality of holes, a mesh screen, or any other well known means in the art. All or some of the slots 59 of each of the lower side 54 may be arranged or configured in a design (not shown) so as to produce an aesthetic effect.

As shown in FIGS. 2 and 3, the compressible chamber 64 is enclosed and defined by the top layer 20, the bottom layer 40, the inner periphery 60, and the outer periphery 62. The chamber 64 is in communication with the receptacle structures 26, 46, the air freshening means, and the slots 58, 59 such that the air current generated by compression of the top layer 20 by the user will make contact with and activate the air freshening means to dispense the air freshening agent, or will make contact with and cause the air freshening means to dispense additional air freshening agent, through the first ends 28, 48 of the respective receptacle structures 26, 46 and through the slots 59 of the lower side 54.

Figure 6:
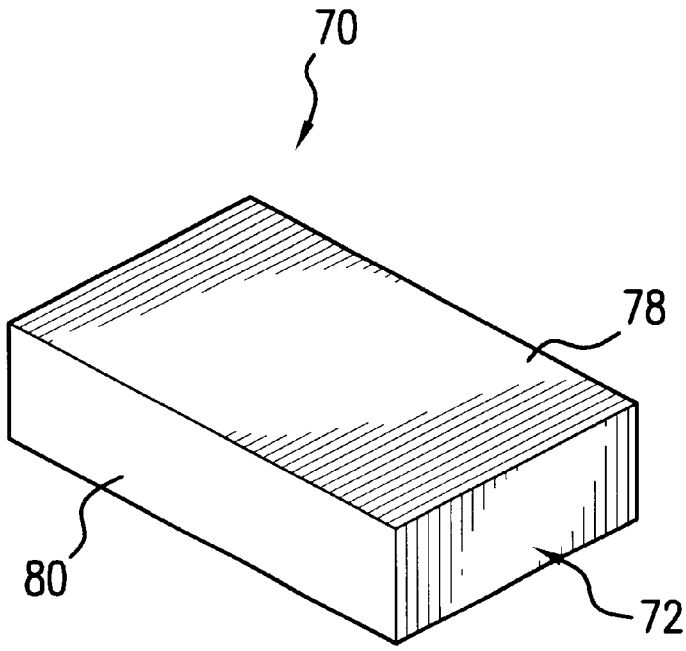
FIG. 6 is a bottom and side perspective view of the cartridge corresponding to the receptacle structure of the top layer of FIG. 4.
Figure 7:
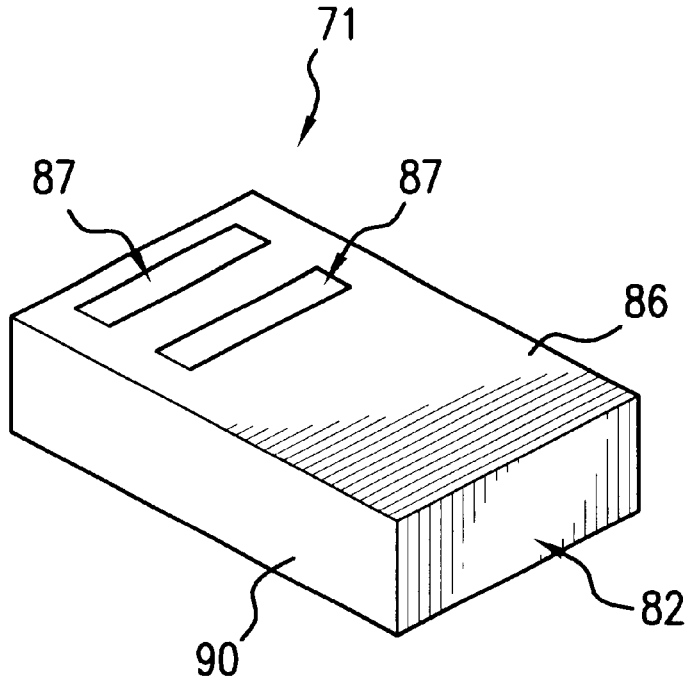
FIG. 7 is a front and side perspective view of a cartridge corresponding to a receptacle structure of a bottom layer of the toilet seat according to the present invention.
Figure 8:
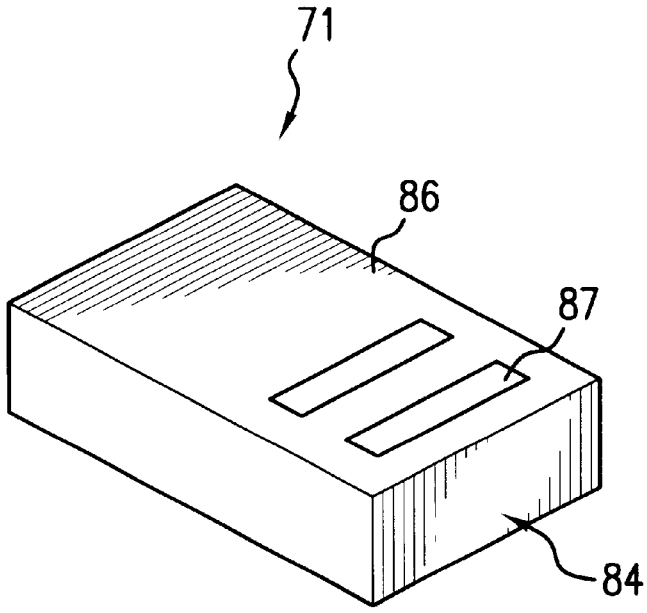
FIG. 8 is a rear and side perspective view of the cartridge corresponding to the receptacle structure of the bottom layer of FIG. 7.
Figure 9:
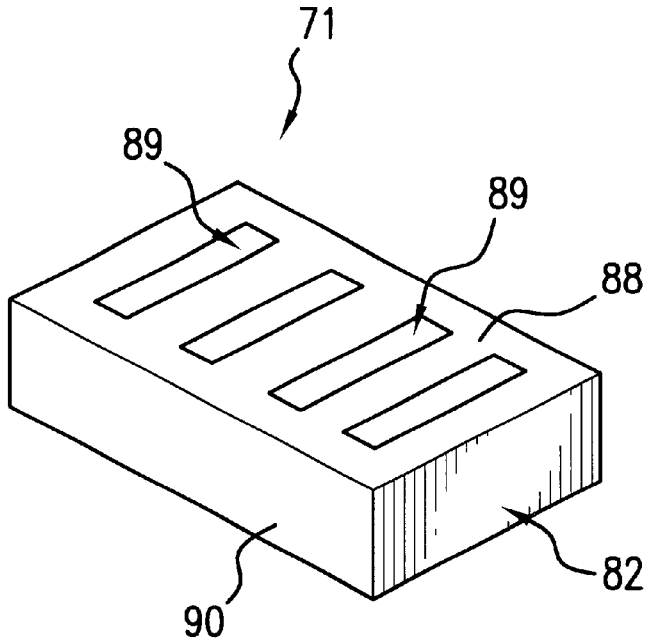
FIG. 9 is a bottom and side perspective view of the cartridge corresponding to the receptacle structure of the bottom layer of FIG. 7.

The seat 10 may further comprise at least one removable cartridge 70, 71 (as shown in FIGS. 4–9) that is adapted for being inserted into and removably contained within a corresponding receptacle structure 26,46 and for receiving the air freshening means and/or the air freshening agent. The removable cartridge 70, 71 corresponding to the receptacle structure 26,46 preferably has similar features to those of the receptacle structure 26,46. As shown in FIGS. 4–6, the removable cartridge 70 has an open first end 72, a substantially closed second end 74 with a plurality of slots 75, a closed upper side 76, a closed lower side 78, a pair of closed sides 80, and a shape similar to that of the receptacle structure 26. As shown in FIGS. 7–9, the removable cartridge 71 preferably has an open first end 82, a closed second end 84, a substantially closed upper side 86 with a plurality of slots 87, a substantially closed lower side 88 with a plurality of slots 89, a pair of closed sides 90, and a shape similar to that of the receptacle structure 46. Each of the respective removable cartridge 70, 71 permits the user to be able to more conveniently replenish or refill the air freshening means and/or the air freshening agent with a minimal possibility of coming into contact with the air freshening means and/or the air freshening agent. Alternatively, instead of the cartridge 70, 71 being removable, the cartridge 70, 71 may be molded into or fixedly attached within the corresponding receptacle structure 26,46.

The seat 10 is preferably manufactured of one piece construction. The top layer 20 is preferably made of a resilient, cushioning material, such as a foam material, a flexible rubber material, and any other well known resilient, cushioning material in the art. The bottom layer 40 is preferably made of a rigid material, such as wood, rigid plastic, metal, and any other well known material in the art.

Other constructions may be realized by those of ordinary skill in the art including the top layer 20 being made of a combination of hard and resilient materials such that only a portion forms a compressible chamber. Additionally, the top and bottom layers 20, 40 may be integrally formed of rigid material with compressible portions provided therein forming the chamber.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An air freshening toilet seat for reception atop a toilet bowl, comprising:

a toilet seat body defining a seating structure for accommodating a weight of a user, said toilet seat body having a generally annular shape which presents an inner periphery and an outer periphery, said toilet seat body including an enclosed compressible chamber disposed therewithin, said toilet seat body being constructed such that a volume of said compressible chamber is compressed when the weight of the user is applied thereto; and receptacle structure defining at least one reception chamber disposed in said seating structure, said reception chamber having an open input end disposed on a laterally accessible portion of said outer periphery of said toilet seat body and at least one opening in communication with said compressible chamber, said reception chamber being configured for receiving and removably accommodating an air freshening element containing an air freshening agent inserted through said input end and for at least partially restricting movement of the air freshening element held within said reception chamber, such than when the freshening element is received in said receiving chamber, a sufficient amount of air freshening agent is directed into the atmosphere about the user in response to a forced passage of air through said reception chamber generated by a compression of said compressible chamber resulting from the weight of the user being applied to said toilet seat body, the air freshening cartridge being slidably receivable in said reception chamber through said input end, said input end including a retaining lip for contactingly engaging a lower portion of an end of the cartridge to inhibit unintentional dislodgment thereof from the reception chamber when held therein.

2. The air freshening toilet seat according to claim 1, wherein said retaining lip is flexible.

3. The air freshening toilet seat according to claim 1, wherein said receptacle structure is defined by a contiguous structural portion of said toilet seat body.

4. The air freshening toilet seat according to claim 1, wherein said input end is generally configured in a shape selected from the group consisting of a rectangle, a square, and a circle.

5. The air freshening toilet seat according to claim 1, wherein said toilet seat body is manufactured of a one piece construction.

6. The air freshening toilet seat according to claim 1, wherein said toilet seat body includes an upper portion deformable over at least an area portion thereof and a base portion comprised of a rigid structure which is supportable on the toilet.

7. The air freshening toilet seat according to claim 6, wherein said reception chamber extends inward of the base portion, at least a portion of said reception chamber being located in a position below said compressible chamber.

8. The air freshening toilet seat according to claim 6, wherein said reception chamber extends inward of the upper portion, at least a portion of said reception chamber being located in a position lateral of said compressible chamber.

9. The air freshening toilet seat according to claim 1, wherein said receptacle structure includes a structural portion serving as a stop which prevents slidable insertion of the air freshening element beyond a given amount.

10. The air freshening toilet seat according to claim 9, wherein said structural portion serving as a stop includes a wall partially defining said receptacle structure, said at least one opening in communication with said compressible chamber being formed in said wall and having a size smaller than said air freshening element.

11. The air-freshening toilet seat according to claim 10, wherein said air freshening cartridge is substantially received within said reception chamber.

12. The air-freshening toilet seat according to claim 1, in combination with said air freshening element, said air freshening element being comprised of an air freshening cartridge including a housing configured for insertion into a particular one of said at least one reception chamber, said housing being structurally configured for receiving a replenishable supply of the air freshening agent.

13. The air-freshening toilet seat according to claim 12, wherein said housing includes at least one aperture corresponding in position with said at least one opening in communication with said compressible chamber when received therein and at least another aperture in another position communicative with the atmosphere about the user.

* * * * *